United States Patent [19]

Rosser et al.

[11] Patent Number: 4,763,131

[45] Date of Patent: Aug. 9, 1988

[54] LOG-PERIODIC MONOPOLE ANTENNA ARRAY

[75] Inventors: William D. Rosser, Los Altos; Samuel C. Kuo, Saratoga; Gustavo E. Bird, Redwood City; Robert E. Davis, Sunnyvale, all of Calif.

[73] Assignee: GTE Government Systems Corporation, Stamford, Conn.

[21] Appl. No.: 19,282

[22] Filed: Feb. 26, 1987

[51] Int. Cl.[4] ..... H01Q 11/10

[52] U.S. Cl. ..... 343/792.5; 343/793; 343/807; 343/811

[58] Field of Search ..... 343/792.5, 793, 807, 343/811

[56] References Cited

U.S. PATENT DOCUMENTS

| | | | |
|---|---|---|---|
| 2,480,154 | 8/1949 | Masters | 343/793 |
| 2,869,125 | 1/1959 | Bouchard | 343/811 |
| 3,056,960 | 10/1962 | Wickersham | 343/811 |
| 3,101,474 | 8/1963 | Wickersham | 343/792.5 |
| 3,123,827 | 3/1964 | Arnold | 343/792.5 |
| 3,286,268 | 11/1966 | Barbano | 343/792.5 |
| 3,308,470 | 3/1967 | Bell | 343/792.5 |
| 3,396,399 | 8/1968 | Winegard | 343/811 |
| 3,427,659 | 2/1969 | Finneburgh | 343/792.5 |

*Primary Examiner*—William L. Sikes
*Assistant Examiner*—Hoanganh Le
*Attorney, Agent, or Firm*—Douglas M. Gilbert; John F. Lawler

[57] ABSTRACT

In a log-periodic monopole antenna array of the type described in U.S. Pat. No. 3,286,268, each antenna of the array having active elements spaced over the top surface of a ground structure and grounded parasitic elements interspersed between the active elements, the improvement of means for mechanically and electrically connecting the parasitic elements to a non-solderable ground structure comprising an elongated block compressed into a correspondingly shaped groove in the structure. Screw means threadedly engage the ground structure in a direction transversely of the top surface thereof and abut against the block. The lower strip portion of the parasitic elements is disposed in the groove between the block and a groove side wall and is compressed therebetween when the screw means is tightened into the structure and against the block. In one embodiment, one side of the block and the adjacent side of the groove are tapered toward the opposite side of the groove so as to force the block against the strip when the screw means is tightened. In another embodiment the block abutting surface of the head of the screw means is tapered and forces the block against the strip when the screw means is tightened. A tight mechanical and electrical connection of the parasitic element strip portions in the array of antennas is thus achieved in a minimum of space.

7 Claims, 5 Drawing Sheets

LOG-PERIODIC MONOPOLE ANTENNA ARRAY

BACKGROUND OF THE INVENTION

This invention relates to log-periodic antennas, and more particularly to an improved log-periodic monopole antenna array.

U.S. Pat. No. 3,286,268 discloses a log-periodic monopole antenna with active elements spaced above a ground plane and with parasitic log-periodic elements interspersed between the active elements. The active and parasitic elements may be formed on opposite sides of a dielectric PC board by printed circuit techniques and the parasitic elements, through an integral grounding strip, are connected to ground as by soldering or the like. In applications requiring a ground plane structure made of aluminum or the like, soldering cannot be used for this purpose and instead, according to prior art practice, a two-piece aluminum ground structure clamped to opposite sides of the PC board has been employed. Fasteners such as screws extend through ground structure flanges and the PC board transversely of the latter and cause the flanges to tightly squeeze against the parasitic element strip and produce a good electrical and mechanical bond.

The above clamping practice is effective with a single monopole antenna but cannot be used in an array of such antennas in which the spacing between adjacent antennas is severely limited. This is especially true of such antennas designed to operate at microwave frequencies where the lateral spacing between adjacent antennas at the high frequency end of the array may be 6 mm or less.

This invention is directed toward a solution to this problem.

OBJECTS AND SUMMARY OF THE INVENTION

A general object of the invention is the provision of a log-periodic monopole antenna array having parasitic elements and means for grounding such elements to a non-solderable ground structure.

Another object is the provision for such grounding for an antenna array that operates at microwave frequencies.

These and other objects of the invention are achieved with a grounding technique for each antenna of an array consisting of an elongated groove in the top surface of the ground structure for receiving the parasitic element portion of the antenna, a clamping block disposed coextensively in the groove, and screw means threadedly engaging the ground structure in a direction transverse to the top surface of the structure and abutting the block, the groove, block and/or screw means being shaped so as to force the block transversely of the groove when compressed therein and to tightly clamp the parasitic element portion against the ground structure.

DESCRIPTION OF PREFERRED EMBODIMENTS

Figure 1:
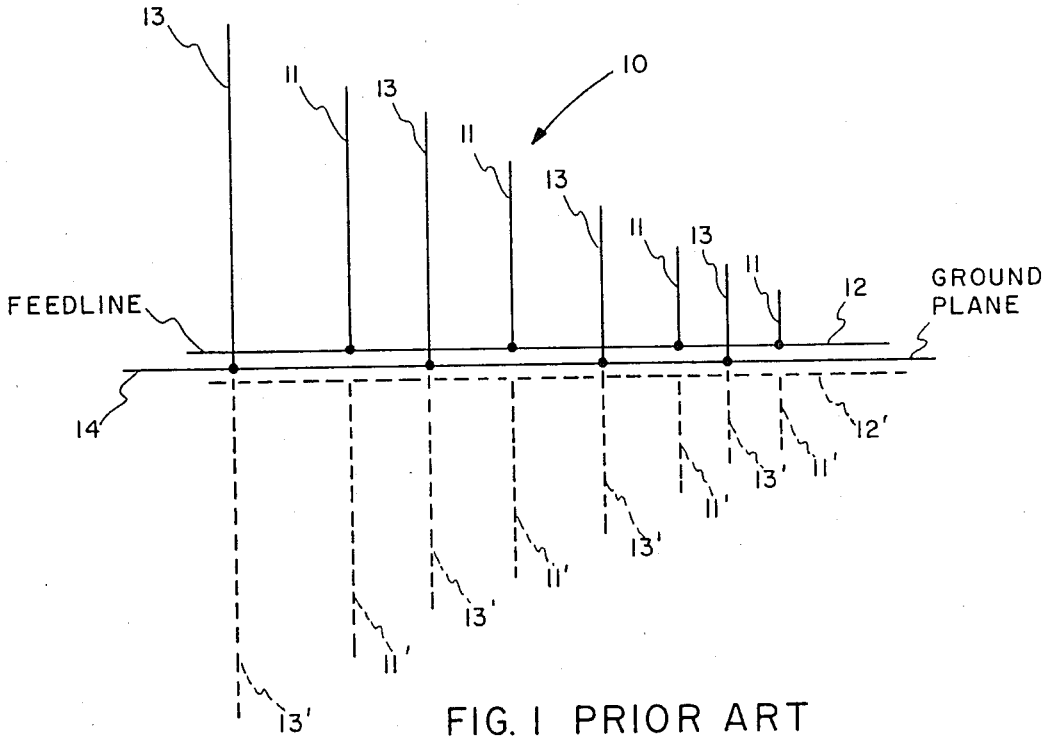
FIG. 1 PRIOR ART
FIGS. 1 and 2 are schematic and partial isometric views, respectively, of a prior art log-periodic monopole antenna.

Referring now to the drawings, FIG. 1 shows the construction of a prior art log-periodic monopole antenna 10 comprising active (radiating or receiving) elements 11 in a vertical plane as shown connected to feed line 12, and parasitic elements 13 connected to ground 14, depicted as a plane, interspersed between active elements 11 and in substantially the same vertical plane. Broken lines 11', 12' and 13' represent the images, respectively, of elements 11, line 12 and elements 13. Details on the construction and operation of this antenna are set forth in U.S. Pat. No. 3,286,268.

Figure 2:
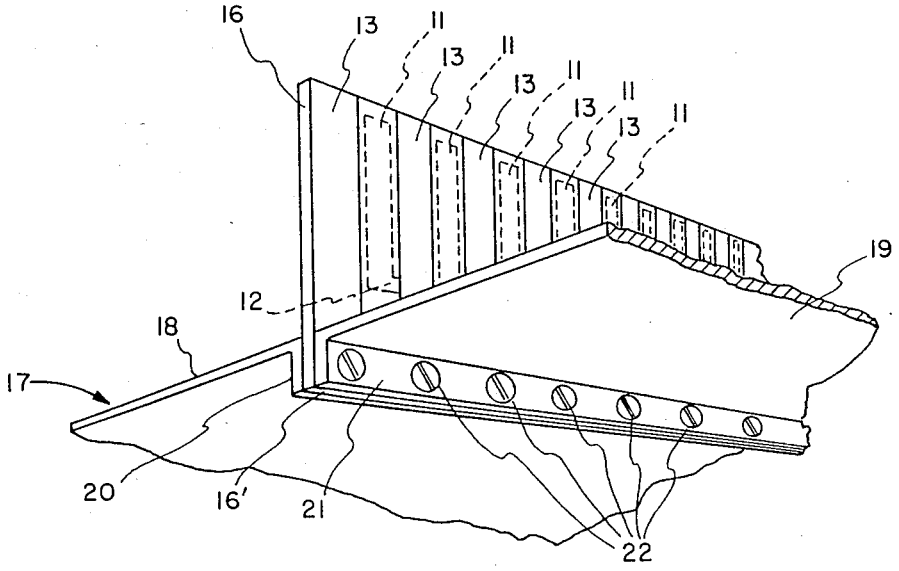
FIG. 2 PRIOR ART
Figure 3:
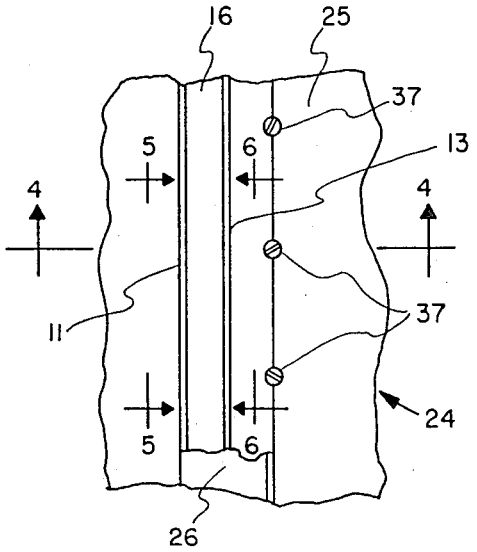
FIG. 3 is a fragmentary top plan view of one embodiment of the invention using PC board antenna construction.
Figure 5:
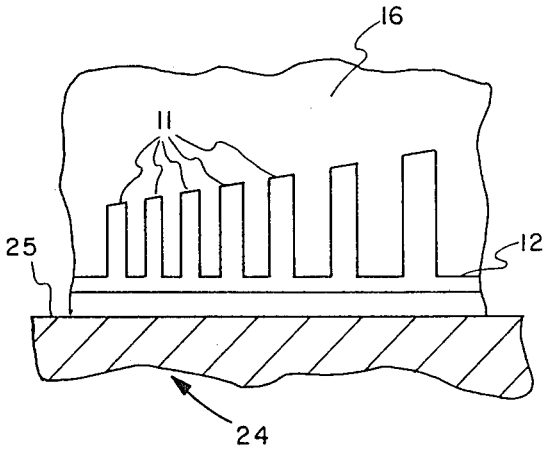
FIGS. 5 and 6 are side views of the antenna taken along lines 5—5 and 6—6, respectively, of FIG. 3.

One prior art form of construction of antenna 10 is shown in FIG. 2 and comprises a dieletric PC board 16 with parasitic elements 13 on one side and active elements 11 on the other, the latter shown in dotted lines, like reference characters indicating like parts on the drawings. Feed line 12 is spaced above the lower edge 16' of PC board 16 while parasitic elements 13 extend to edge 16'. A ground plane structure 17 comprises parts 18 and 19 having opposed flanges 20 and 21, respectively, between which PC board is tightly clamped by screws 22 extending through flanges 20 and 21 transversely of board 16. Top surfaces 18' and 19' of parts 18 and 19, respectively, are flat and coplanar and together constitute the ground plane of the antenna. This clamping technique insures not only a secure mechanical connection between structure 17 and PC board 16 but also effects a good electrical connection between parasitic elements 13 and structure 17. In applications having minimum weight requirements, ground plane structure 17 preferably is composed of aluminum or the like to which solder connections cannot be made and hence a clamp-type electrical connection is employed. The disadvantage of the type of construction shown in FIG. 2 is that it cannot be used with high frequency, including microwave, log-periodic monopole arrays because of the close spacing of antennas, especially at the high frequency end of the array.

Figure 10:
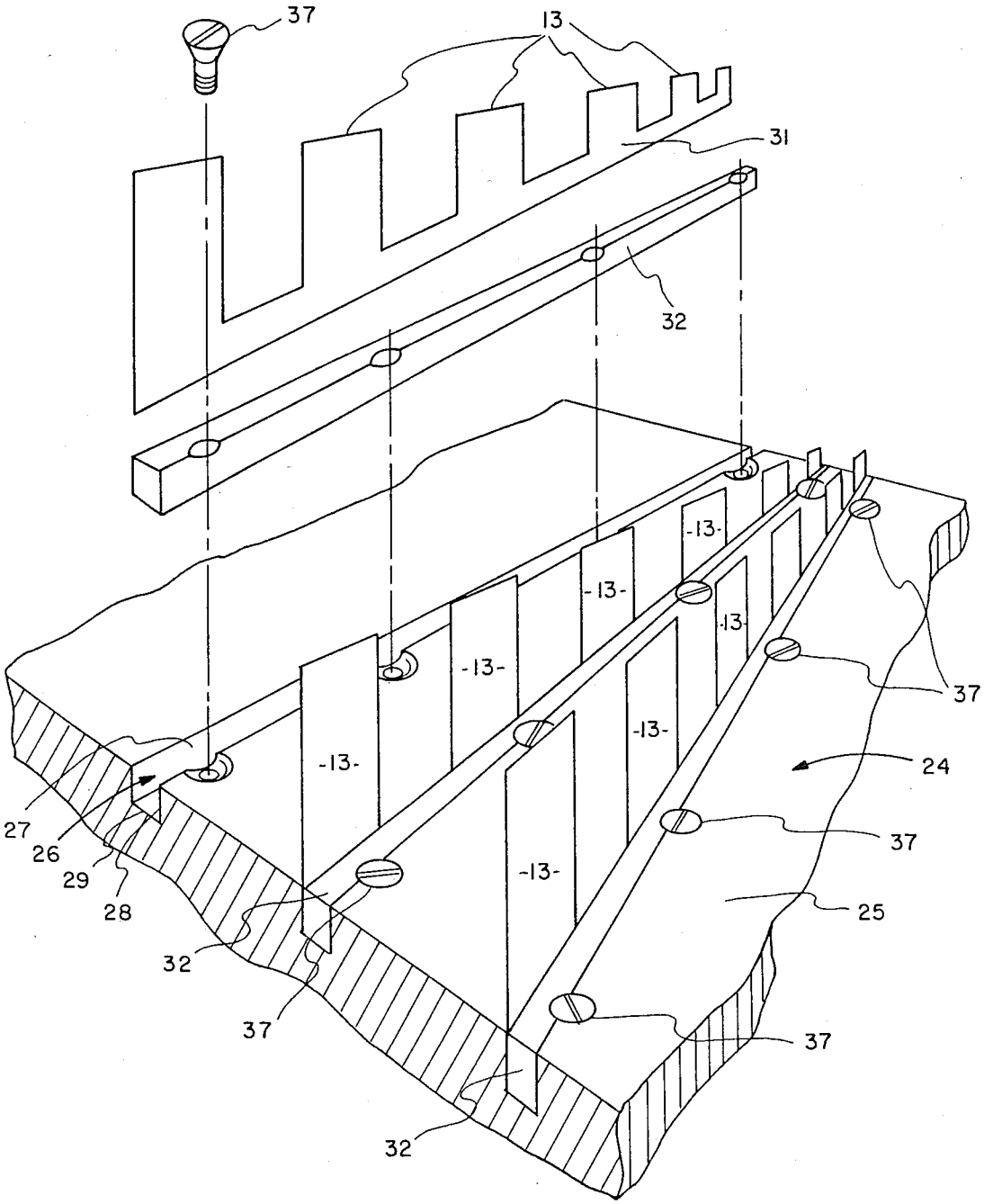
FIG. 10 is a simplified perspective schematic partially-exploded view of an antenna array embodying the invention, part of the antenna structure being omitted for clarity of illustration.

Referring to FIGS. 3–6, inclusive, and FIG. 10 in which like parts on the drawings are indicated by like reference characters, one embodiment of this invention comprises a unitary ground stucture 24 having a plane top surface 25 with a plurailty of elongated grooves 26 formed therein corresponding to the number of antennas, respectively, in the array. Each groove 26 is defined by side surfaces 27 and 28 and a bottom surface 29. PC board 16 has active antenna elements 11 and feed line 12 therefor formed on one side with feed line 12 spaced above top surface 25, and parasitic elements 13 formed on the opposite side of board 16. Board 16 is sufficiently thick to be self-supporting and yet is thin enough that elements 11 and 13 are substantially in the same plane electrically.

Parasitic elements 13 are electrically interconnected at one end by a longitudinally continuous conductive strip 31 preferably adjacent to the lower edge 16' of board 16 as shown. As elongated block 32 having top surface 33, bottom surface 34 and side surfaces 35 and 36 fits into each groove 26 with top surface 33 substantially flush with surface 25 of ground structure 24. PC board 16 is disposed with its lower edge 16' bottomed in groove 26 between block 32 and side surface 27 of the groove and with parasitic elements strip 32 against side surface 35 of block 32. Opposite side surface 36 of block 32 and adjacent side surface 28 of groove 26 are equally tapered inwardly toward the opposite side 27 of the groove as shown. When block 32 and PC board 16 are disposed in groove 26 as shown, bottom surface 34 of block 32 is spaced slightly from bottom surface 29 of groove 26. Screws 37 fastened to ground structure 17 transversely of its top surface 25 engage block 32, forcing the latter downwardly into groove 26 and laterally against board 16 of tapered abutting surfaces 28 and 35.

Figure 7:
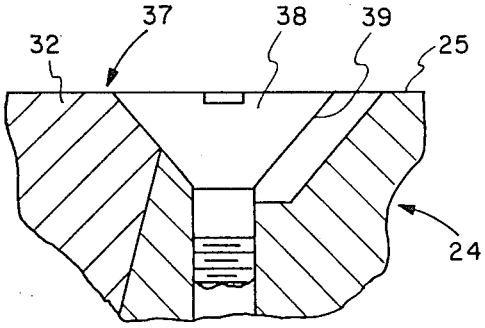
FIG. 7 is an enlarged view of a portion of FIG. 4 showing details of the taper-headed screw.
Figure 8:
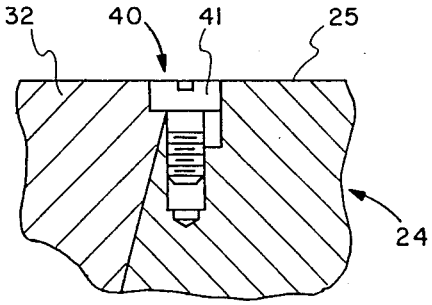
FIG. 8 is a view similar to FIG. 7 showing an alternate form of screw head configuration.

Each screw 37 has a head 38 with a tapered side 39, see also FIG. 7, which engages the top edge of block 32. Alternatively, a screw 40, see FIG. 8 with a cylindrical head 41 may be used to accomplish the same result. Thus with tapered sided block 32, a high degree of lateral force is applied against PC board 16, insuring good electrical contact between parasitic element strip 31 and ground structure 17.

Figure 4:
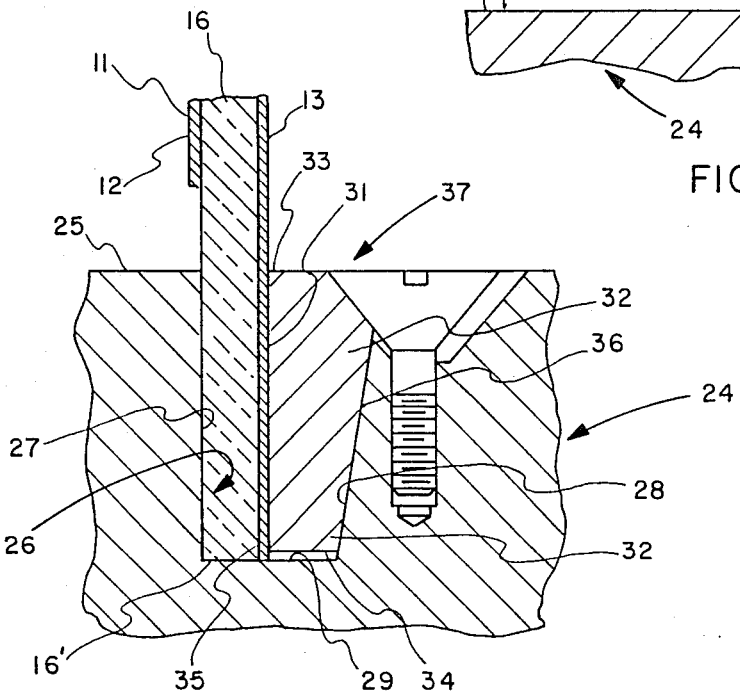
FIG. 4 is an enlarged transverse section taken on line 4—4 of FIG. 3.
Figure 6:
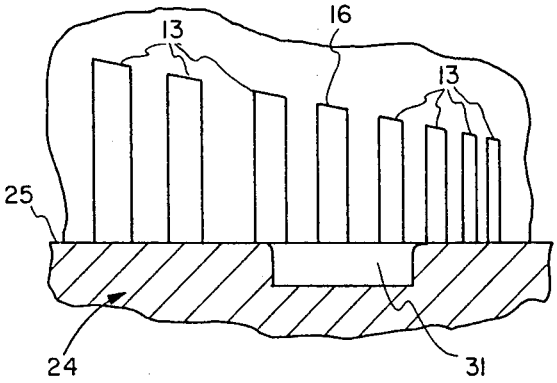

In the embodiment shown in FIG. 4 wherein block 32 abuts against parasitic element strip 31, block 32 is composed of an electrically conductive material such as steel. It will be understood, however, that block 32 may be composed of an electrically nonconducting material if the positions of active elements 11 and parasitic elements 13 on the sides of board 16 are reversed wherein strip 31 abuts against side surface 27 of groove 26.

Figure 9:
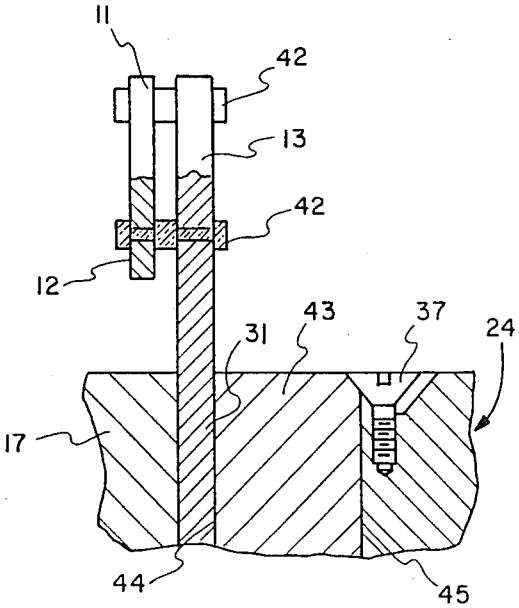
FIG. 9 is a view similar to FIG. 4 showing a modified form of the invention.

Another embodiment of the invention is shown in FIG. 9 in which active elements 11 and parasitic elements 13 (together with strip 31) are fabricated by etching same from thin but self-supporting brass sheets. Elements 11 are supported directly on and laterally spaced from parasitic elements 13 by dielectric fasteners 42. FIG. 9 also shows another form of block 43 having parallel sides 44 and 45, the tapered-screws 37 developing sufficient lateral forces against block 43 to cause the latter to tightly squeeze strip 31 against ground structure 17.

FIG. 10 shows an array of three log-periodic structures of parasitic elements 13' and strips 31' having a construction as shown in FIG. 9, the active antenna elements having been omitted for the sake of clarity of illustration. The antennas (three as shown) of the array converge from left to right as illustrated toward the feed point so that the lateral spacing between adjacent arrays reduces to a minimum. For arrays operating in the microwave frequencies, this minimum spacing may be in the order of 6 mm. In order to further accommodate such close spacing of adjacent arrays, blocks 32 may also be longitudinally tapered, as shown, or otherwise gradually reduced in width toward the feed (right as viewed) end of the array.

Figure 11:
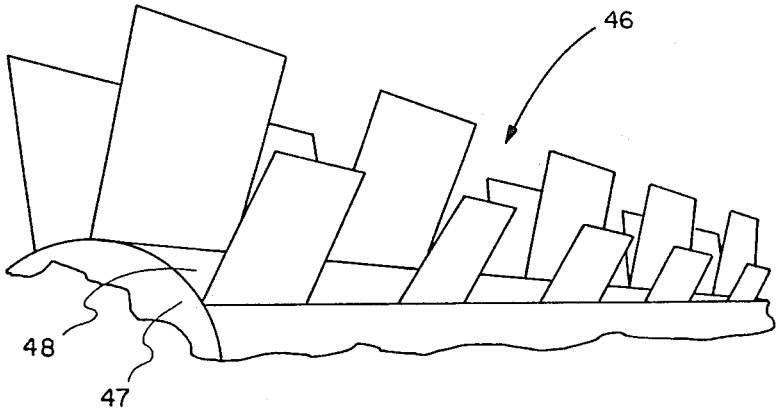
FIG. 11 is a view similar to FIG. 10 with a conically-shaped ground surface.

While the invention is practiced with advantage in conjunction with a ground structure having a plane top surface, the invention is not limited to such a structure. FIG. 11 illustrates an embodiment of the invention with a log-periodic antenna array 46 having a ground structure 47 with a conically shaped top surface 48, the other aspects of construction being essentially the same as described above.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings. For example, the parasitic elements 13 may be permanently bonded to the side of block 32 to form a unitary structure without departing from the principle of the invention.

What is claimed is:

1. In a log-periodic monopole antenna having a plurality of axially spaced log-periodically related active elements in a plane and connected to a feed line, and a like plurality of integrated log-periodically related axially spaced parasitic elements having an electrically conductive strip interconnecting same along adjacent ends thereof, said parasitic elements being insulated from and supported substantially in said plane between and axially alternating with said antenna elements, and an electrically conductive ground structure having a top surface, the improvement of means for electrically connecting said parasitic elements to said structure with said antenna and parasitic elements projecting outwardly from said surface, comprising:

an elongated block having top and bottom surfaces and side surfaces therebetween;

said structure having an elongated groove defined by side and bottom surfaces;

said block and said strip being juxtaposed in said groove, and screw means threadly engaging said structure along an axis extending transversely of the top surface of said structure, said screw means having a head portion with a side surface abutting against said block, at least one of said side surfaces of said screw head portion and said groove being tapered for tightly squeezing said strip into electrical contact with said ground structure when said screw means is tightened into said structure and against said block.

2. The antenna according to claim 1 in which at least one of the sides of said block and the adjacent side of said groove are tapered from the top surface of said structure toward the opposite side of the groove.

3. The antenna according to claim 1 in which the side of said screw head portion is tapered and said sides of said groove and of said block are substantially parallel.

4. The antenna according to claim 1 in which said top surface of said ground structure is planar.

5. The antenna according to claim 1 in which said top surface of said ground structure is conically shaped.

6. In a log-periodic monopole antenna having a plurality of axially spaced log-periodically related active elements connected to a feed line, and an integrated electrically conductive interconnected strip of axially spaced parasitic elements, said parasitic elements being insulated from and supported between said active elements in axially alternating positions, and an electrically conductive ground structure having a top surface, the improvement of means for mechanically and electrically connecting said strip to said structure with said antenna and parasitic elements normal to the said surface, comprising:

an elongated block having top and bottom surfaces and side surfaces therebetween;

said structure having an elongated groove defined by side and bottom surfaces;

said strip and said block being disposed in juxtaposition in said groove with said side surfaces of the groove respectively in abutment with said strip and one of the side surfaces of the block, said abutting side surfaces of said groove and said block being transversely tapered inwardly from the top surface of said structure and toward the opposite side of the groove; and screw means threadedly engaging said structure and having a head portion abutting against said block for pressing said abutting surfaces together and for squeezing said strip tightly against the adjacent side of said groove.

7. A log-periodic monopole antenna having a ground structure with a top surface, a plurality of plane parallel axially spaced first and second sets of elements projecting outwardly from said surface, the elements of the first set axially alternating with and being substantially coplanar with elements of the second set, the improvement of means for mechanically and electrically connecting one of said sets of elements to said ground structure, comprising:

an elongated block having first and second side surfaces;

said structure having an elongated groove with first and second side surfaces for receiving said block and a portion of one of said sets of elements between said side surfaces of the groove and the block; and screw means threadedly engaging said structure, said screw means having a tapered head portion abutting against said block and pressing said block tightly against said one set of elements when said screw means is tightened into said structure.

* * * * *